US006739471B2

(12) United States Patent
Goetz et al.

(10) Patent No.: US 6,739,471 B2
(45) Date of Patent: May 25, 2004

(54) CONTAINER WITH ROTARY CLOSURE

(76) Inventors: Hermann Goetz, Walter-Rathenau-Strasse 39, D-65428 Ruesselsheim (DE); Bruno Ackermann, Königsberger Strasse 103, D-55268 Nieder-Olm (DE); Dieter Folland, Pfarrgasse 32, D-65239 Hochheim (DE)

( * ) Notice: Subject to any disclaimer, the term of this patent is extended or adjusted under 35 U.S.C. 154(b) by 45 days.

(21) Appl. No.: 10/231,964

(22) Filed: Aug. 30, 2002

(65) Prior Publication Data

US 2003/0080130 A1 May 1, 2003

(30) Foreign Application Priority Data

Sep. 7, 2001 (DE) ..... 201 14 741

(51) Int. Cl.[7] ..... B65D 51/20
(52) U.S. Cl. ..... 220/258.4; 220/906; 220/253
(58) Field of Search ..... 220/258.4, 258.58, 220/258.1, 259.3, 268, 267, 277, 278, 253, 906

(56) References Cited

U.S. PATENT DOCUMENTS

| | | | | | |
|---|---|---|---|---|---|
| 3,726,432 | A | * | 4/1973 | Gentile | 220/253 |
| 3,924,777 | A | * | 12/1975 | Peyser | 220/277 |
| 3,949,898 | A | * | 4/1976 | Patel et al. | 220/277 |
| 4,125,203 | A | * | 11/1978 | Sovari et al. | 220/255.1 |
| 4,795,043 | A | * | 1/1989 | Odet et al. | 215/235 |
| 4,821,912 | A | * | 4/1989 | Wells | 220/231 |
| 5,269,432 | A | * | 12/1993 | Beckertgis | 220/253 |
| 5,692,633 | A | * | 12/1997 | Gordon | 220/253 |
| 5,816,427 | A | * | 10/1998 | Beckertgis | 220/253 |
| 6,216,904 | B1 | * | 4/2001 | Cagan | 220/253 |

FOREIGN PATENT DOCUMENTS

DE 200 04 152 U1 8/2001

* cited by examiner

*Primary Examiner*—Lee Young
*Assistant Examiner*—Lien Ngo

(57) ABSTRACT

A container, particularly in the form of a beverage can, which has a drinking opening preparation in its upper lid wall, and may be reclosed after being opened by a rotary lid closure. Means are provided for coupling the rotary lid closure to the lid wall when the lid wall recedes somewhat after opening the container so that the drinking opening made can be reclosed sealingly.

13 Claims, 6 Drawing Sheets

CONTAINER WITH ROTARY CLOSURE

FIELD OF THE INVENTION

The invention relates to a container for accommodating free-flowing products, in particular in the form of a beverage can, which is provided with a predetermined breaking line which, once broken open, produces a drinking or pouring opening. The beverage can is intended to be used particularly for carbonated beverages.

BACKGROUND OF THE INVENTION

Beverage cans usually have a horseshoe-shaped predetermined breaking line which bounds a top or cover wall region of the can, on which a ring pull tab is fastened. If such a beverage can has been opened by virtue of the tab being actuated, it is no longer possible to close it effectively, which, in the case of carbonated drinks, results in the can contents having to be consumed rapidly or the drink otherwise going flat.

In order to cover the drinking or pouring opening it is already known from U.S. Pat. No. 3,726,432 to use an additional lid having a recessed opening and being formed as a rotary slider having a projecting tongue for breaking open the drinking and pouring opening. For doing so, the top wall of the container has a depression with a sloping surface which leads to the region of the later drinking and pouring opening. In this form of the top wall region bounded by the breaking line, it is not possible with the rotary slider to seal such drinking and pouring opening so that carbonated beverages will loose pressure quickly.

A container with a rotary lid closure of the applicants is known from German utility model DE U 200 04 152.5. It has proven difficult to seal carbonated beverages after breaking open the drinking and pouring opening.

Applicants of the present invention have described a beverage container with a rotary lid closure in WO 01/66431 A2 where the drinking and pouring opening will already be sealed after being opened. However, further amendments appear desirable when closing carbonated beverage containers once more.

These sealing difficulties are based on the top wall arching by the gas pressure of the carbonated beverage when the container is closed, this arching however being decreasing when the container is opened. In order to provide a good sealing effect, the rotary lid closure should follow the axial movement of the top wall, and engage the top wall with some pressure, when after breaking up the drinking and pouring opening, the rotary lid closure is being turned covering this drinking and pouring opening.

SUMMARY OF THE INVENTION

An object of the present invention is to provide a container with a rotary lid closure adapted to seal the drinking and pouring opening also in view of carbonated beverages.

With invention, the rotary lid closure is supported on the container on the one hand to initially break up the drinking and pouring opening when turning the rotary lid closure and then, on the other hand, to enable covering and sealing the opened drinking and pouring opening with wall portions of the rotary lid closure. The means for supporting the rotary lid closure include clip formations at the periphery of the rotary lid closure which co-operate with the edge seam between top wall and the rotationally symmetrical wall region of the container.

Furthermore, means for coupling the rotary lid closure to the container top wall are provided which are effective so that the rotary lid closure follows the container top wall when the same recedes somewhat in direction of the container interior due to decreasing inner pressure in the container. The coupling means are formed so as to allow rotary movement of the rotary lid closure relative to the container top wall. Generally, the rotary lid closure together with the coupling means is formed so as the usual stacking possibility of containers and tins one above the other remains preserved.

The coupling means of the rotary lid closure may include an additional central bearing and mounting point or place so as to hold the rotary lid closure closely at the container top wall in order to follow the arching movement up and down of the container top wall which in the case of carbonated beverages occur due to pressure variations.

The central bearing and mounting point or place of the rotary lid closure at the container top wall may comprise a pin-like extension of the container top wall and a hole recess in the rotary lid closure, furthermore latching means are provided to hold the members together. The latching means may include a cramp which may be placed upon the pin-like extension of the container top wall. As latching means also the latching engagement of dents into an annular depression on the pin-like extension can be used. Finally, it is also possible, after mounting the rotary lid closure, to form some kind of rivet head at the pin-like extension.

Additionally or alternatively to the central bearing and mounting point or place, the container top wall and the rotary lid closure may be provided with annular wall portions fitting to one another and defining screw surfaces or bayonet formations which become effective when turning the rotary lid closure so as to press the same onto the drinking and pouring opening, when in the position for covering the drinking and pouring opening, for better sealing purposes.

Finally, it is also possible to make the wall of the rotary closure with a different arching to that of the container top wall so that the rotary lid closure stays pressed onto the container top wall, also if after opening of the container, the container top wall recedes due to decreasing inner pressure in the container.

BRIEF DESCRIPTION OF THE DRAWINGS

The invention will be described with reference to the drawing in which.

DESCRIPTION OF THE EMBODIMENTS

Figure 1:
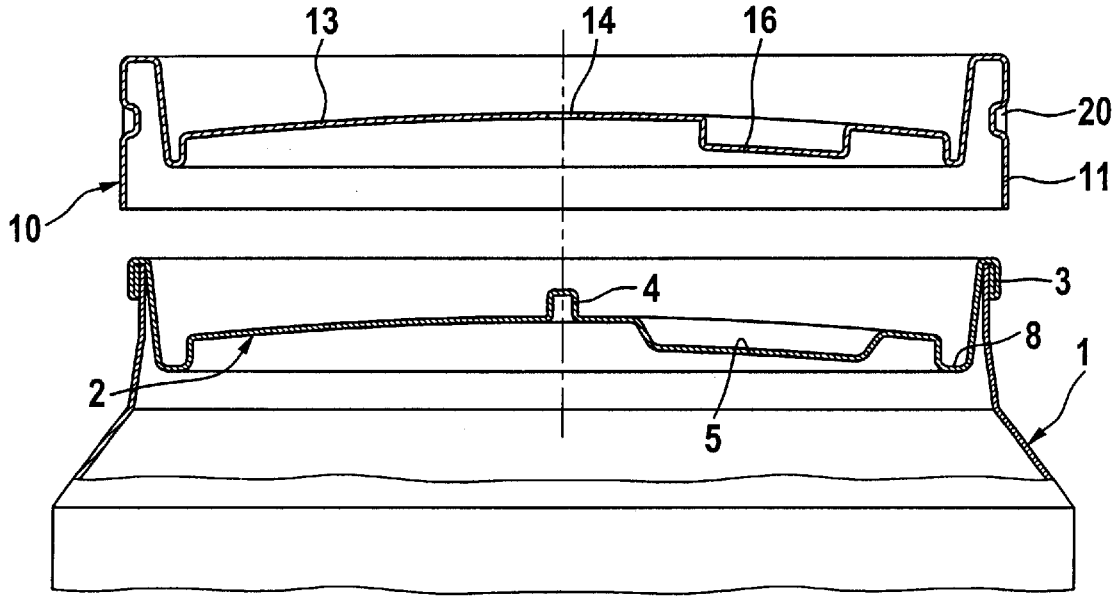
FIG. 1 shows, in an exploded view, a section through the top part of a first embodiment of a can having a rotary lid closure.
Figure 9:
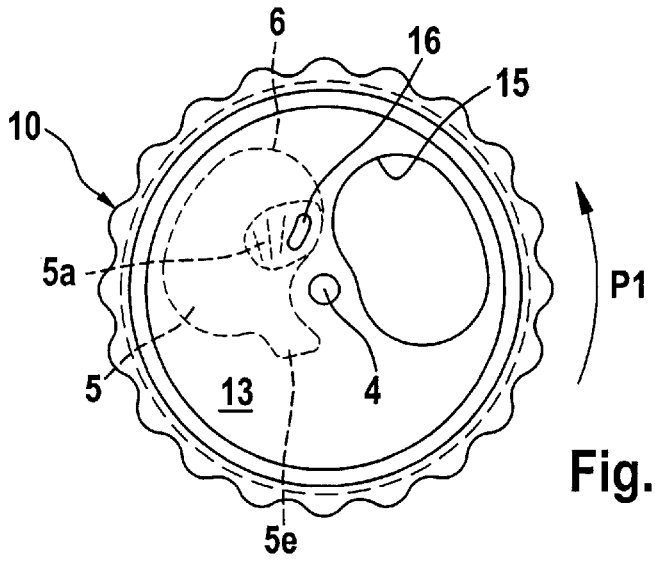
FIG. 9 shows a plan view of the can in the initial position.
Figure 10:
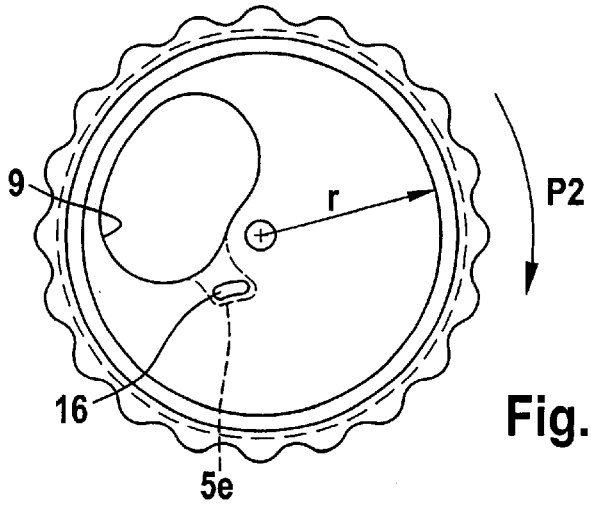
FIG. 10 shows the opening position of the can.
Figure 12:
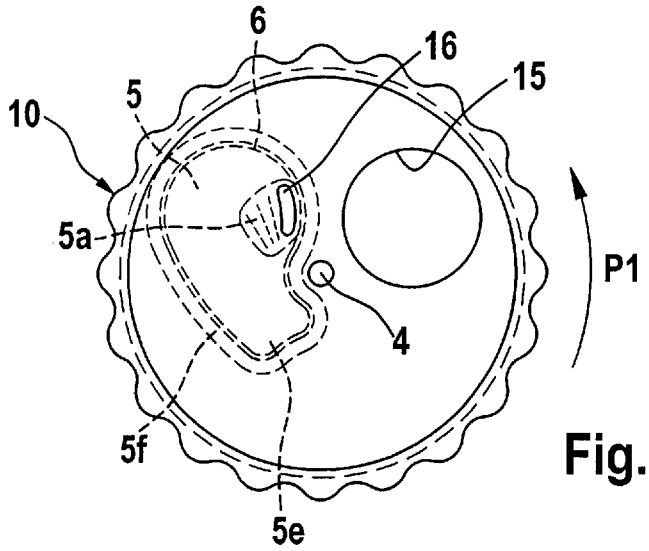
FIG. 12 shows a plan view of a further embodiment of the can in the initial position.
Figure 13:
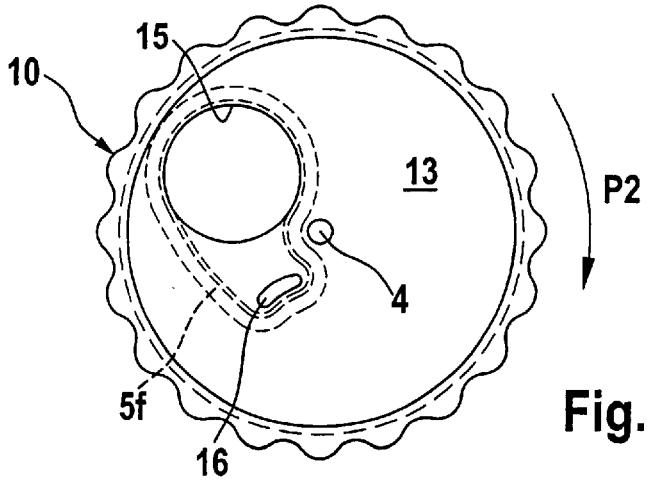
FIG. 13 shows the can in its open position.

FIG. 1 shows the top end of a can, i.e. a rotationally symmetrical wall region 1, i.e. made of tin plate which is closed by a top or lid wall 2, e.g. made of aluminum, an edge seam 3 being formed. The lid wall 2 has an encircling groove 8 and a bounded region 5 which is sunken to some extent in relation to the plane of the lid wall 2 and has been prepared for partial breaking-open action with the help of a notched weakening line 6 which forms a predetermined breaking line (FIGS. 9 and 12). After breaking, a drinking and pouring opening 9 is formed (FIGS. 10 and 13).

Along the symmetrical axis (FIG. 1) a pin-like extension 4 is formed, e.g. by hollow drawn wall portions of the lid 2. A rotary lid closure 10 can be placed onto the lid wall 2. The rotary lid closure preferably is made up of metal and has an encircling annular wall 11 and a rotary shutter or sliding wall 13. The rotary sliding wall 13 has a central opening 4 and a cut-out opening 15 (FIGS. 9 and 12), the latter being of more or less the same shape as the bounded region 5 of the lid wall 2. In a distance S1 from the edge of the opening 15, a downwardly extending boss 16 is provided which e.g. is formed as a corrugation or hollow bead (FIG. 8), that is, is formed by wall portions of the rotary lid shutter 10. In the region of the annular wall 11 a number of flexible depressions 20 (FIG. 7) are formed which in the manner of clips are used for cooperating with the edge seam 3 so as to be able to assemble and hold the rotary lid shutter 10 on the can 1. Three resilient depressions 20 along the periphery of the annular wall 11 are sufficient for that purpose.

Figure 2:
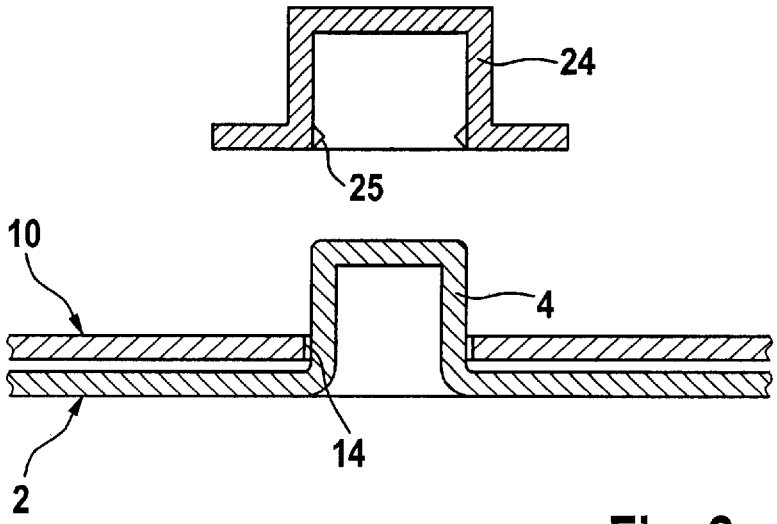
FIG. 2 shows an enlarged detail thereof.

When assembling the rotary lid shutter 10 onto the lid wall 2, the opening 14 encircles the pin-like extension 4 (FIG. 2) and is held thereon by means of a cap-like cramp 24. The cramp is to some extent resilient and flexible and has indentations 25 which dig into the wall of the extension 4 and hold the rotary lid shutter 10 closely to the lid wall 2. Consequently, the rotary lid shutter 10 can be turned, but follows all moments of the lid wall 2 when the same arches outwardly with increasing inner pressure in the can and moves inwardly with decreasing inner pressure. This movement of the lid wall 2 makes some tenths millimeters, the extent of movement depending from the inner pressure in the can and from the thickness of the lid wall. An average extent of movement is 0.4 millimeter, however, also more than 1 millimeter can be reached.

Figure 3:
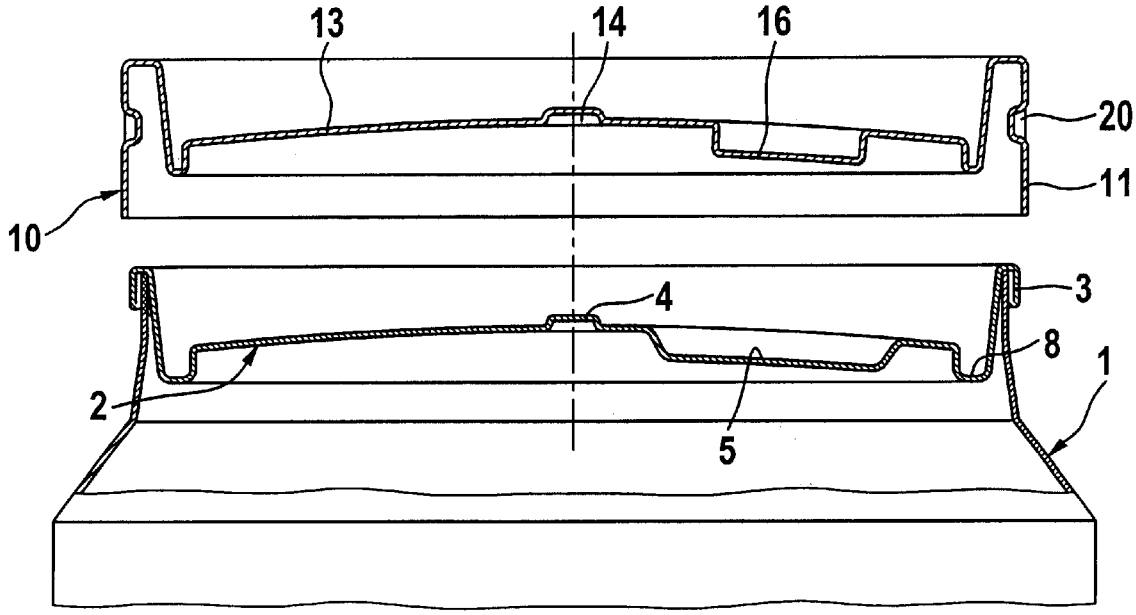
FIG. 3 shows a second embodiment of the top part of the can.
Figure 4:
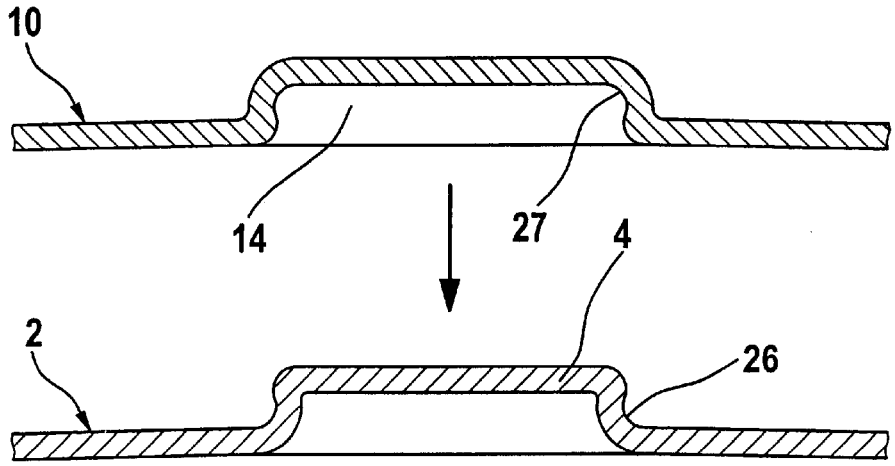
FIG. 4 shows an enlarged detail thereof, FIG. 5 a third embodiment of the top part of the can.

FIGS. 3 and 4 show a further embodiment of the central bearing and mounting place of the rotary shutter 10 on the pin-like extensison 4. For this purpose, an annular depression 26 at the extension 4 and a bulge dent 27 at the rotary lid shutter 10 are provided. The parts are dimensioned so that when assembling the rotary lid shutter 10 onto the lid wall 2, the extension 4 snaps into the dent 27.

Figure 5:
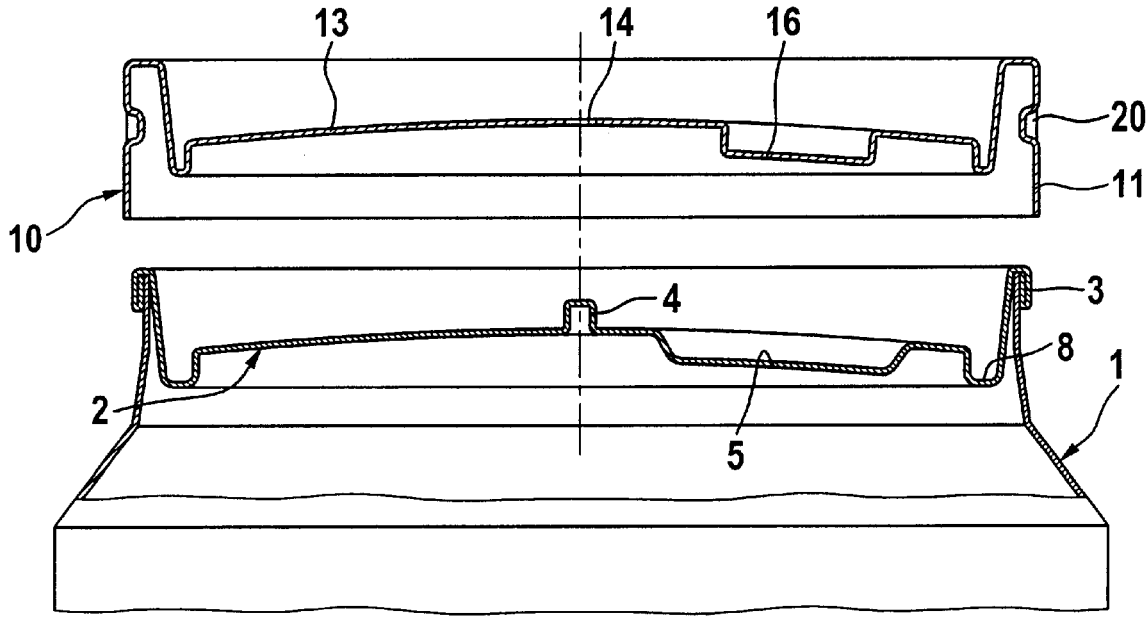
Figure 6:
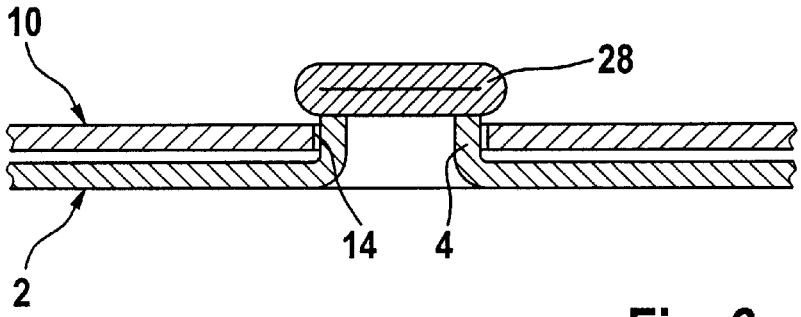
FIG. 6 shows an enlarged detail thereof.

FIGS. 5 and 6 show a further kind of connection between rotary lid shutter 10 and lid wall 2. The opening 14 of the rotary lid shutter 10 is placed onto the extension 4 of the lid wall 2 and the position reached is made sure by a kind of rivet head 28. The rivet head 28 is fixed by a method where relatively rapid vibrations are imposed onto the rivet head 28 so that the heat produced by friction and deformation at the interface between the parts 4 and 28 leads to melting of an intermediate layer and therefore bonding of the parts. This fixing method has the advantage that assembly of the rotary lid shutter 10 to the lid wall 2 is possible with extraordinary low engagement pressure which is of significance when the rotary lid shutter 10 must be mounted even if the inner pressure in the can, in spite of being filled, did not yet build up.

Figure 7:
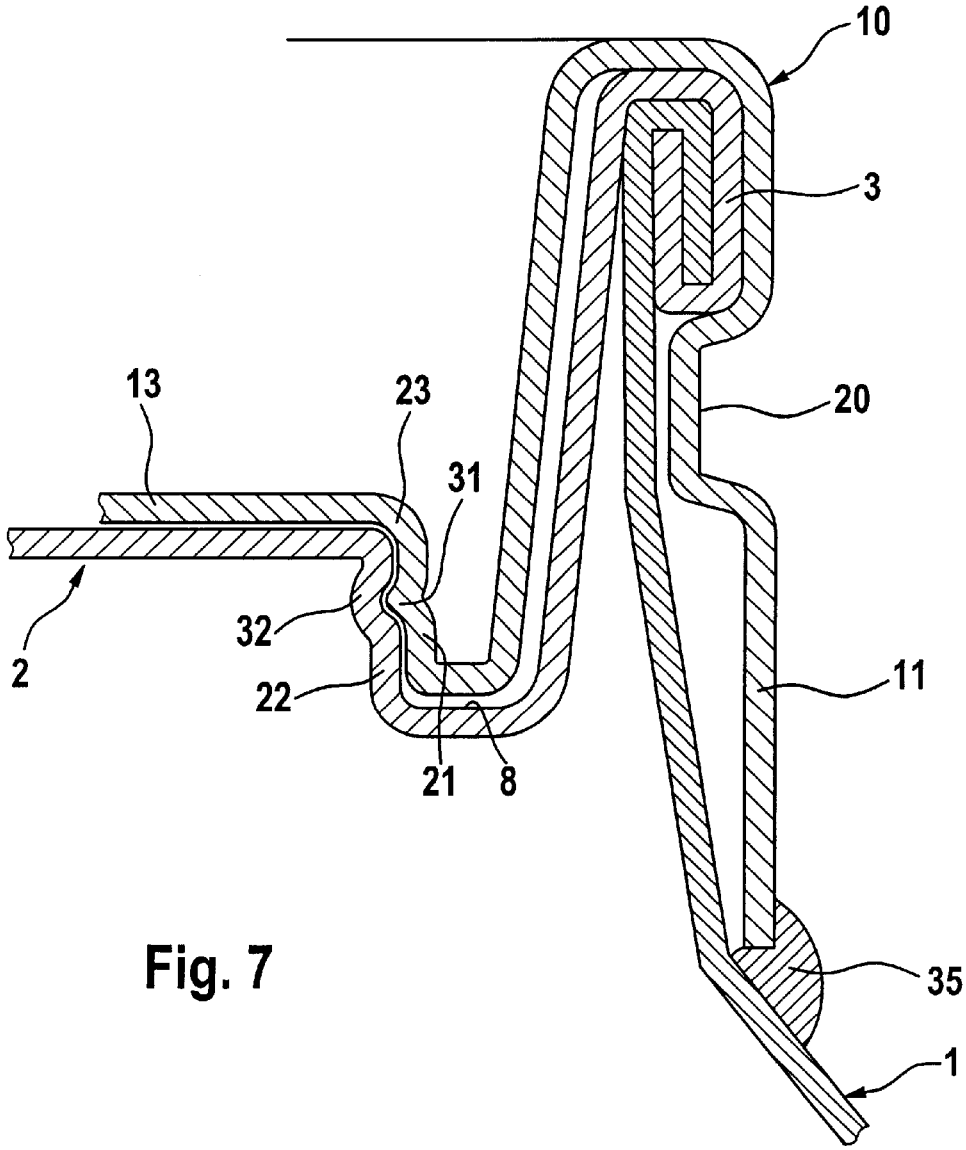
FIG. 7 shows a longitudinal-radial section through a detail of the top part of a can in a variation.
Figure 8:
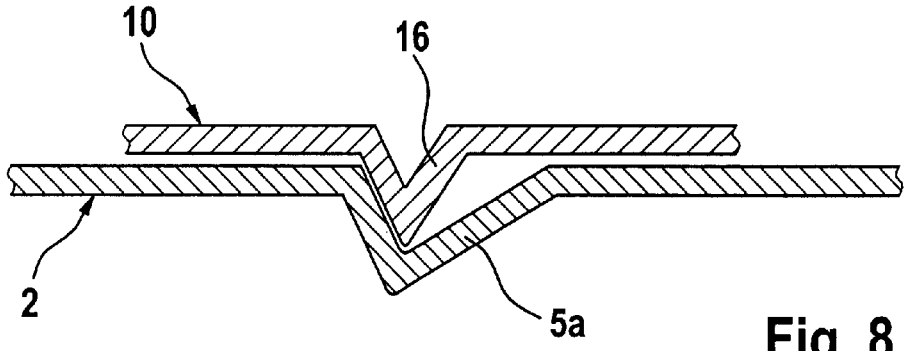
FIG. 8 shows a section through a further detail of the top part of the can.

FIG. 7 shows a longitudinal section through the can in the region of the edge seam of the lid wall 2, however, with some additions. The rotary lid shutter 10 comprises an annular corrugation 21 in the region of the groove 8 formed by the lid wall 2. The annular corrugation 21 has an upper rim 23 which encloses the rotary shutter sliding wall 13 which is arched. By choosing a small vault towards the interior of the can (in the drawing downwardly), the rotary lid shutter 10 will engage the lid wall 2 which is arched into the opposite direction. Alternatively, the vault of the rotary shutter or sliding wall 13 may be in the same direction as the vault of the lid wall 2, however with a different measurement or size, so that in each position of the lid wall 2 pressing engagement is produced by the shutter wall 13.

Figure 11:
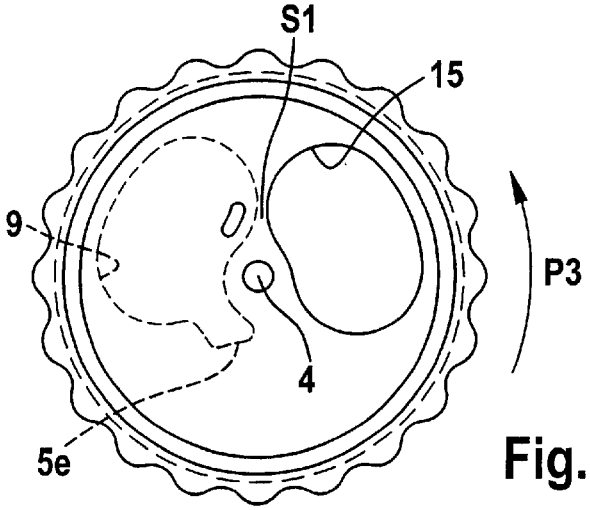
FIG. 11 shows the reclosed position of the can after being opened for the first time.
Figure 14:
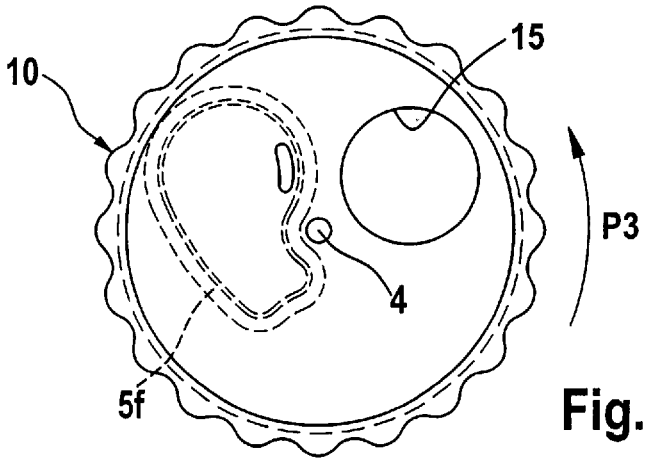
FIG. 14 shows the reclosed can after being opened for the first time.

The prestress produced therewith assists in the sealing function of the shutter wall 13 around the drinking and pouring opening 9 (FIGS. 11 and 14). Namely when the inner pressure decreases after opening of the can, arching of the lid wall 2 decreases, the lid wall receding so-to-say. Due to the prestress of wall 13 of the rotary lid shutter 10, the wall 13 may follow the receding movement of the lid wall 2 and engage the sealing region of the can opening with some contact pressure.

However, pressure engagement of the wall 13 on the lid wall 2 increases friction when turning the rotary lid closure 10. Since the prestress is applied for purposes of sealing, it is only needed in the position of FIGS. 11 and 14, respectively, of the rotary shutter. Such pressure engagement of the wall 13 around the periphery of the pouring opening 9 which depends from the rotary position may be made up by short screw surfaces 31, 32 or bayonet formations on the axially extending annular walls 21 and 22 of the rotary shutter 10 and the lid wall 2, respectively, as indicated in FIG. 7. In the position of FIGS. 10 and 13 of the rotary shutter 10, the same moves without higher pressure on the underlying lid wall 2, whereas a higher pressure is produced when approaching the position of FIG. 11 or 14 so as to increase the sealing effect.

In order to keep the receding of the lid wall 2 small, it is possible to stiffen this lid wall 2 with an annular stiffening corrugation. With a view of the intended purpose of improved sealing after reclosing the can, it is preferred to arrange the annular stiffening corrugation around the bounded region 5. Sealing matter may be anchored in this stiffening corrugation to form a sealing layer **5*f* as shown in FIGS. 12 through 14**.

As also shown in FIG. 7, the outer annular wall 11 of the rotary shutter comes close to the rotationally symmetrical wall region 1 of the can, and the gap between members 11 and 1 is bridged at a spot by seal material 35 which so to say forms a tamper indication which is broken up when turning the rotary lid closure 10. The seal material may contain temperature colour changing substance harmonised with the desired drinking temperature of a beverage filled in the can.

FIGS. 9 through 11 show a beverage can having a kidney-shaped drinking opening which may be relatively large.

FIGS. 12 through 14 show a circular drinking opening.

FIGS. 9 and 12 each show the starting position wherein the can is still closed. As shown, the boss 16 is placed above the sloping surface 5*a* of the depression 5 and slides or rides up onto this surface when the rotary lid shutter 10 is turned in direction of the arrow P1. Increasing pressure is imposed onto the surface 5 so that the weakened line 6 breaks and the wall portion 5 is bent downwardly with the exception of the end region 5*e* which remains unbroken. Thereupon, the position of FIG. 10 or 13 is reached in which the recessed opening 15 overlaps the drinking and pouring opening so formed. By turning back according to arrow P2, the rotary lid closure may be returned into its initial position wherein, however, the drinking opening 9 remains broken up (FIGS. 11 and 14). The sealing layer 5*f* around the drinking opening 9 which co-operates with the lower side of the shutter wall 13 may improve the sealing effect. If the can is to be opened again, the rotary shutter 10 is turned (arrow P3) to reach the position of FIG. 10 or 13.

It will be apparent to those skilled in the art that suitable modifications, variations and equivalents may be made without departing from the scope of the invention, such scope being limited solely by the terms of the claims and the equivalents thereof.

What is claimed is:

1. A container comprising:

a rotationally symmetrical wall region;

a lid wall having a circular circumference and being fixed with an edge seam to said rotationally symmetrical wall region along the circumference thereof;

a bounded region of said lid wall extending between an axis of rotation and the circular circumference of said lid wall and being enclosed by a predetermined breaking line which, once broken open, releases a single drinking and pouring opening;

a depression having a sloping surface which is formed by wall portions of said lid wall within said predetermined breaking line;

a rotary lid closure which includes a rotary sliding wall which spans said lid wall, an opening cut out therein, and a boss for riding on said sloping surface so as to break open said drinking and pouring opening;

means for supporting said rotary lid closure upon said edge seam of said lid wall when said rotary lid closure is actuated for breaking open said drinking and pouring opening, and means for coupling said rotary lid closure to said lid wall such that said rotary lid closure follows said lid wall when the same recedes somewhat in direction of the container interior due to decreasing inner pressure in the container after breaking up of the drinking and pouring opening.

2. The container of claim 1 wherein said means for supporting said rotary lid closure comprises wall formations of said rotary lid closure forming clips to co-operate with said edge seam of said lid wall, and wherein said means for coupling said rotary lid closure to said lid wall comprises a central bearing and mounting place effective to hold said rotary slider wall of said rotary lid closure closely to said lid wall, said rotary lid closure being additionally supported when said drinking and pouring opening is being broken up.

3. The container of claim 2 wherein said bearing and mounting place comprises a pin-like extension of the lid wall and a hole recess in the rotary lid closure, said pin-like extension and said hole recess having latching means to interlock with one another.

4. The container of claim 3 wherein said latching means include a cramp engaging said pin-like extension with clamping effect.

5. The container of claim 3 wherein said latching means include an annular depression on said pin-like extension and dents at said rotary lid closure which interengage.

6. The container of claim 3 wherein said latching means comprise rivet head means fixed to said pin-like extension after assembly of the rotary lid closure.

7. The container of claim 3 wherein said pin-like extension consists of hollow drawn wall portions of said lid wall.

8. The container of claim 1 wherein said means for coupling said rotary lid closure to said lid wall comprise annular wall portions fitting into one another and being provided with screw surfaces or bayonet formations and arranged to press said rotary lid closure in its shutting position onto the drinking and pouring opening.

9. The container of claim 1 wherein a sealing liner is provided on said lid wall in the region of said drinking and pouring opening.

10. The container of claim 9 wherein said sealing liner is anchored in a stiffening corrugation encircling said bounded region.

11. The container of claim 1 wherein said means for coupling said rotary lid closure to said lid wall comprises a vault of said rotary slider wall such that said rotary slider wall engages said lid wall with prestress also if there is no inner pressure within the container.

12. The container of claim 1 wherein said rotary lid closure includes a gripping rim wall which extends to said rotationally symmetrical wall region of the container forming a gap thereto and wherein said gap is bridged by sealing material at one spot.

13. The container of claim 12 wherein said sealing material contains temperature colour changing matter.

* * * * *